United States Patent [19]

Strange

[11] Patent Number: 4,889,447

[45] Date of Patent: Dec. 26, 1989

[54] MARINE POLLUTION CONTAINMENT DEVICE

[76] Inventor: Booth B. Strange, 11106 Wickway, Houston, Tex. 77042

[21] Appl. No.: 387,521

[22] Filed: Jul. 31, 1989

[51] Int. Cl.[4] ..... E02B 15/04

[52] U.S. Cl. ..... 405/60; 210/923; 405/195; 114/77 R

[58] Field of Search ..... 405/60, 63–72, 405/11–14, 210; 114/77 R, 352; 210/923

[56] References Cited

U.S. PATENT DOCUMENTS

| | | | |
|---|---|---|---|
| 3,078,938 | 2/1963 | Bollum | 114/77 R X |
| 3,186,369 | 6/1965 | McLennan et al. | 114/77 R X |
| 3,320,919 | 5/1967 | Deal | 114/77 R |
| 3,331,211 | 7/1967 | Cravens et al. | 405/12 |
| 3,347,051 | 10/1967 | Bjerke et al. | 405/210 |
| 3,638,437 | 2/1972 | Fukuda | 405/12 |
| 3,800,542 | 4/1974 | Cerasari | 405/72 |
| 3,973,406 | 8/1976 | Casey | 405/70 X |
| 4,120,793 | 10/1978 | Strain | 210/275 |
| 4,290,714 | 9/1981 | Strange | 405/60 |
| 4,477,348 | 8/1984 | Ayers et al. | 210/242.3 |
| 4,626,128 | 12/1986 | Devine | 405/12 |

FOREIGN PATENT DOCUMENTS

| | | | |
|---|---|---|---|
| 2063776 | 6/1981 | United Kingdom | 405/60 |

OTHER PUBLICATIONS

Flexy Oil Spill Control Equipment.
Abasco Products Guide.
American Petroleum Institute Task Force Report om Oil Spills, Jun. 14, 1989.

*Primary Examiner*—Dennis L. Taylor
*Attorney, Agent, or Firm*—William A. Knox

[57] ABSTRACT

A marine pollution containment barge consists of two semi-circular hulls, which, when joined together at the extremities thereof, define an interior well that is open to the water. The semi-circular hulls may be separated. The hulls are self-propelled independently of each other and each may be dynamically positioned independently of the other.

10 Claims, 4 Drawing Sheets

MARINE POLLUTION CONTAINMENT DEVICE

BACKGROUND OF THE INVENTION

RELATION TO OTHER APPLICATIONS

This application is related to my co-pending U.S. patent application Ser. No. 07/387,520.

1. Field of the Invention

This invention is concerned with the containment and removal of marine pollution, preferably at or near its immediate source, to prevent further dispersal of the pollution into the environment. The invention has particular application to containment and recover of good clean oil in the open sea, in rough water under adverse weather conditions.

2. Discussion of the Prior Art

Major spills of pollution material such as crude oil occur infrequently in the marine environment but when they do happen, the results can be catastrophic. The disastrous effects stem not so much from the actual localized flow of the pollution from a point source, but from the uncontrolled widespread dispersal of the material over the water surface due to wave, wind and current action. If the flow of pollution can be substantially contained at or near the source, the environmental impact of the spill is minimal.

Although the environmental effects of a crude-oil spill are of concern, the economic loss of that natural resource is also of importance. Once the spill has spread over a large area, even if the thin layer of scum can be recovered, it becomes so badly emulsified by the water that the scum cannot be economically processed. It is wasted. Recovery of the crude at the source, before it becomes seriously water-contaminated, is essential. For example, the PEMEX oil spill in the Gulf of Mexico several years back, lost more than 900,000 barrels of oil. At $20/barrel, the monetary loss amounted to more than $18 million. Applicant believes that if the teachings of this disclosure had been then available, at least 90% of the oil lost at sea could have been recovered.

Another problem in handling pollutant spills is the response time in the dispatch of spill containment devices. Historically, it has required days or even weeks to mobilize those devices and to put them into place. By that time it is often too late. Oftimes, the delay is due to bureaucrats' and environmentalists' wrangling over the best cleanup method. Effective oil-recovery units should be immediately available at all major centers of production and transportation.

Most of the presently-known pollution-control equipment is directed to merely skimming the already-dispersed pollution from the water surface and pumping the scum into holding tanks or pits. Skimmers typically consist of buoyant plastic or rubber curtains suspended from a rope or cable. A typical oil-spill containment boom made by Hurum Marine Inc. of Longueil, Quebec, is their FLEXY 3 oil boom. The curtain has a draft of 24" and a freeboard of 12". The boom is made in 50' sections, any number of which allegedly may be coupled together as required. The boom is handled by small tugs. That sort of oil containment boom is of marginal use in harbors or other relatively protected waters but it is ineffective on the high seas where wave heights of 5 to 15 feet are not uncommon. The waves of the open ocean wash the floating oil slick over the 1-foot freeboard of the boom, rendering the boom completely useless if, indeed, the boom itself actually survives the vicious pounding of the waves. Even in calm water, heavy crude sometimes forms large globs of congealed oil. The shallow-draft curtains tend to slide over the globs rather than raking them in.

Other types of pollution cleanup devices include rope mops, blotters, weir skimmers, oil sorbents and chemical oil dispersants such as supplied for example, by Abasco of Houston, TX. Those techniques may be helpful in cleaning up dispersed pollution in quiet water, but are of little use in containing a spill at the source ab initio.

Another class of oil skimmer and recovery device that allegedly is potentially useful in rough water, is taught by U.S. Pat. No. 4,120,793, issued 10/17/78 to P. J. Strain and U.S. Pat. No. 4,447,348, issued 10/16/84 to W. M. Ayers et al. In those patents, suitable machinery in a sea-going ship or barge presumably sucks up the pollutant-contaminated water through a sluice gate located at the bow or stern of the respective ships, separates the oil from the water and transfers the separated oil to holding tanks or the like for later recovery. In a recent oil spill in Alaska, a foreign-registry ship similar to the above type proved ineffective.

In both patents, the ships are provided with booms much as above described. In rough water, the booms are of no use as I have explained earlier. The effective width of the skimming-swath of the ships is thus restricted to the beam of the ships themselves, a width of perhaps 40 to 60 feet. Such ships would be hard-pressed to cope with the flow of crude from a source such as a ruptured tanker, a broken pipe line or a leaking oil well wherein the oil, flowing upwardly from the leak, has been diffused into a plume having a substantial surface expression. The area of the plume is a function of the depth of the oil leak, the currents and the wind.

A third type of device is exemplified in my U.S. Pat. No. 4,290,714, issued 09/22/81. In that patent, I provided a barge, having a well, the barge being intended to be anchored directly over the source of an oil leak. The barge included a long telescoping sleeve hanging under the well, or alternatively, a plastic tubular sleeve that extended downwards from the well, to be secured to the sea floor around the source of the leak. The objective of the sleeve configuration was to contain the rising plume of pollution to prevent it from becoming dispersed in the water.

There are a number of disadvantages to the '714 device. The barge was immobile once it was anchored in place; its position could not be readily adjusted to maneuver the barge over the surface expression of the leak as the rising oil plume drifted about due to changing ocean currents. The mechanisms for handling the telescoping sleeve were too complicated to be practical. The plastic tubular sleeve, while interesting in concept, would be almost impossible to put in place. The configuration of the barge made it clumsy for tugs to handle in the open sea. Nevertheless, the '714 patent is incorporated herein by reference but only to the extent of its disclosure of pertinent prior art and known techniques for pumping, burning and/or otherwise disposing of recovered oil and/or gas.

SUMMARY OF THE INVENTION

It is the object of this invention to provide a self-propelled barge, capable of rapid deployment, that can be dynamically positioned in the open ocean in rough seas over or near the surface expression of a leaking pollutant. The barge is expandable in area to provide a pollutant collection swath of a width that is sufficient to significantly reduce the chance of further dispersal of the pollutant into the surrounding environment.

In accordance with an aspect of this invention, I provide a sea-going barge that includes two substantially semi-circular hulls. When the semi-circular hulls are joined together at their opposite extremities, the joined hulls define an interior curvilinear well therebetween that is open to the water. The bottom of each hull is tapered upwardly towards the interior well in the manner of an inverted funnel. The barge includes means for pumping accumulated water-polluting material from the interior well to a pollution-material receiving and transporting means.

In another aspect of this invention, the barge is self-propelled and includes means for dynamically positioning the barge with respect to a source of pollution.

In yet another aspect of this invention, each hull is self-propelled independently of the other hull.

In an aspect of this invention, at least one of the semi-circular hulls may be maneuvered broadside, adjacent a leaking tanker ship that has a ruptured oil storage tank. A flexible gasket is provided that seals the bulkheads, at the opposite extremities of the semi-circular hull, to the undamaged portions of the side of the leaking tanker. The outboard contacting surface of that portion of the gasket that faces the side of the tanker is equipped with an electromagnetic clamp to magnetically seal the gasket to the tanker.

BRIEF DESCRIPTION OF THE DRAWINGS

These and other advantages of my invention will be better understood by reference to the appended description and the drawings wherein.

DETAILED DESCRIPTION OF THE PREFERRED EMBODIMENT

Figure 1:
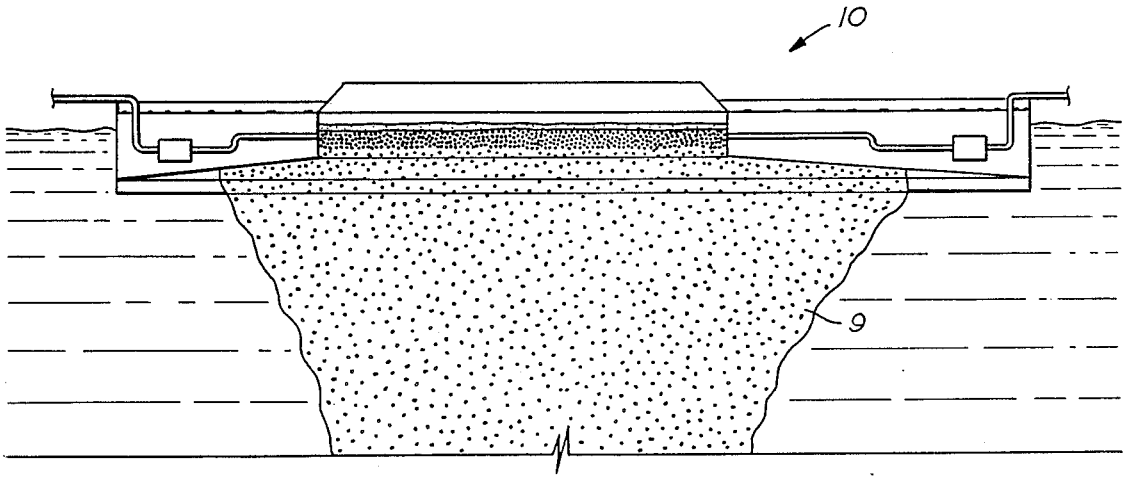
FIG. 1 is a schematic view of an oil-collection barge hovering over a plume of oil leaking into a body of water.

With reference to FIG. 1, there is shown, in longitudinal cross section, the barge 10 of this invention hovering over a plume, 9, of leaking crude that is issuing from a sub-sea oil leak.

Figure 2:
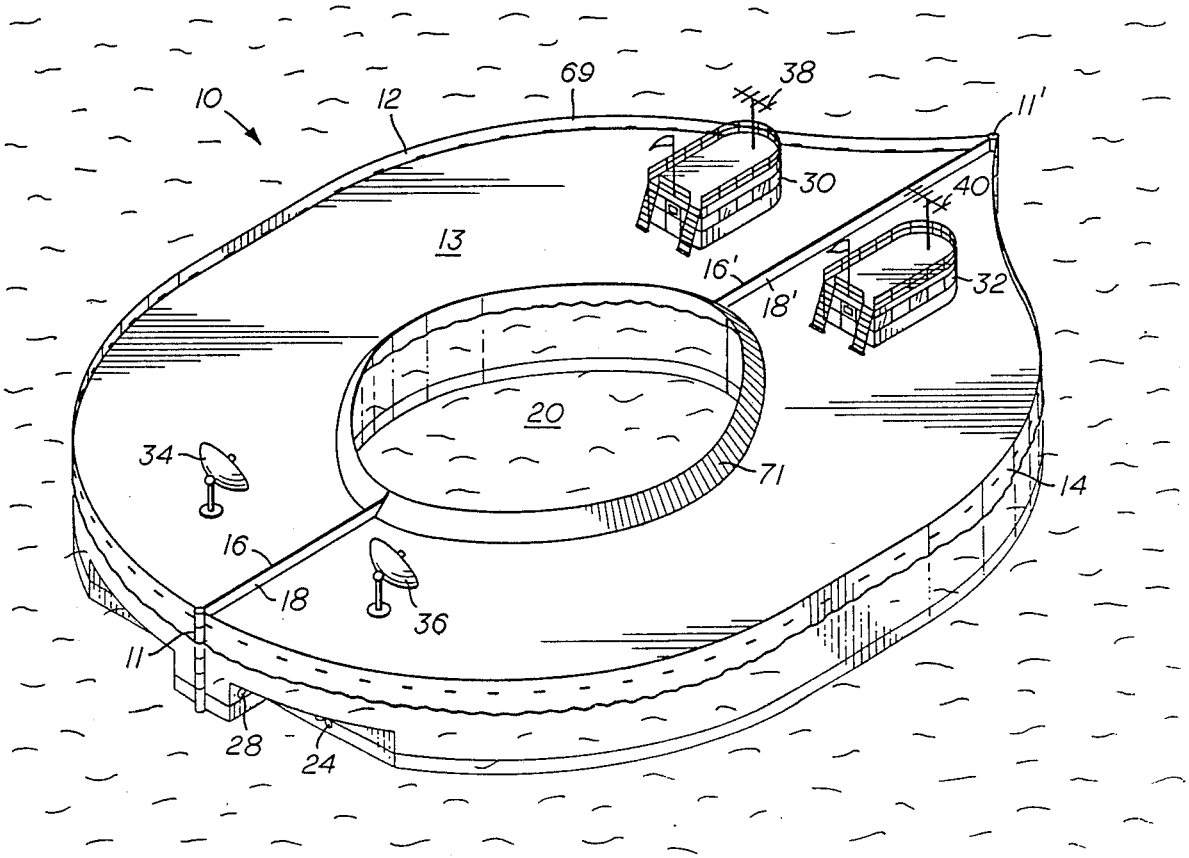
FIG. 2 is an isometric view of the barge of this invention.
Figure 3:
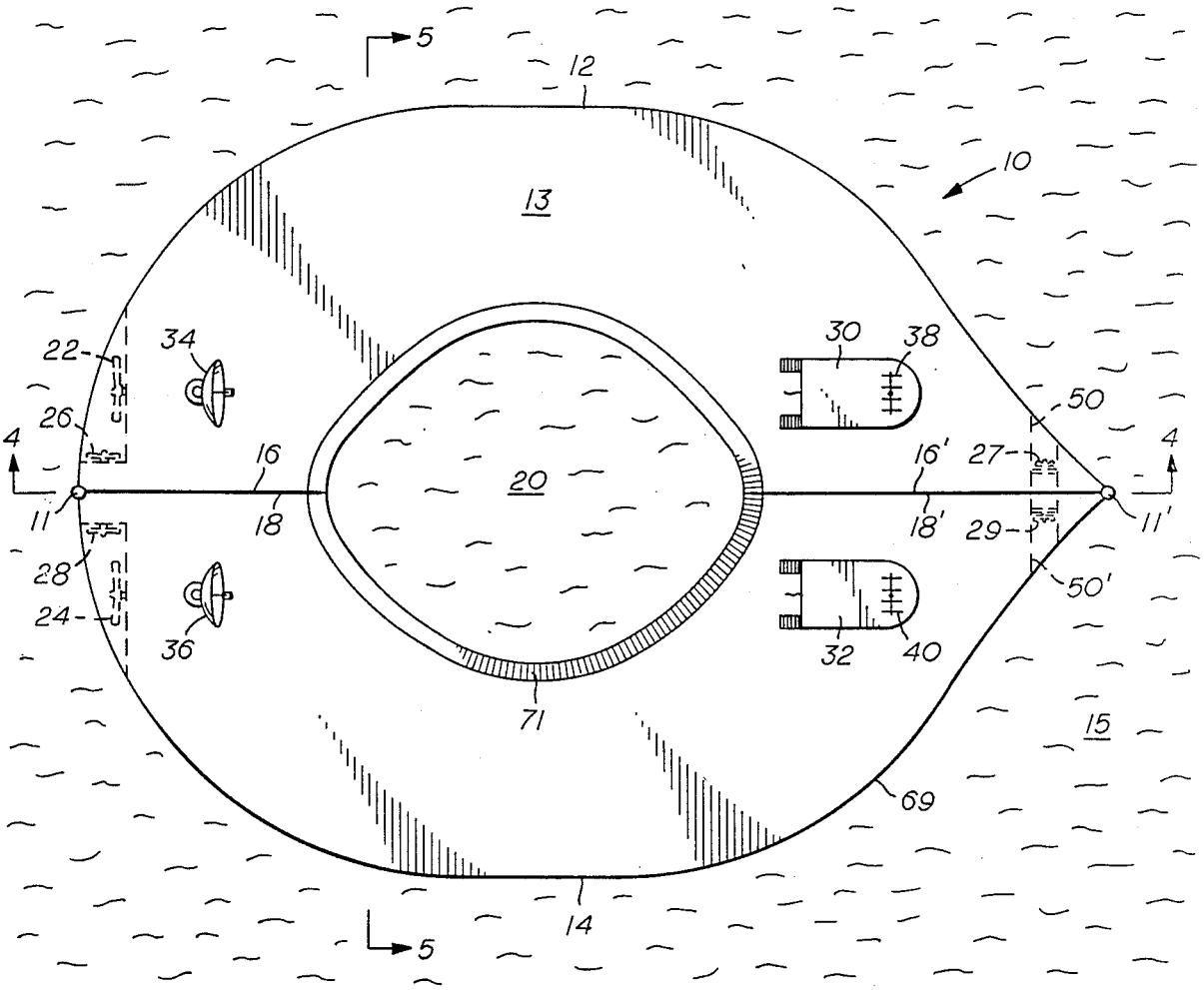
FIG. 3 is a plan view of FIG. 2.

FIGS. 2 and 3 are isometric and plan views respectively, of the oil containment barge 10 of my invention. Barge 10 consists of two substantially semi-circular hulls, 12 and 14, that are sealed off by bulkheads 16, 16' and 18, 18' respectively, located at the opposite extremities of each hull. The hulls are joined together at the extremities by any convenient means such as massive hinges having hinge pins 11, 11'. When joined together as shown, the semi-circular hulls define an interior curvilinear well 20, that is open to the water as will be seen in later Figures. The interior well may be circular, elliptical or any other convenient shape. The two hulls together may occupy an area exceeding that of a football field; the area of internal well 20 may exceed that of a large city lot. It is to be understood that adequate deck space is provided for operating personnel and equipment as well as for living and messing quarters. Inasmuch as each hull is designed to be operated independently of the other, special structural reinforcement must be provided to prevent twisting of the hull about its longitudinal axis.

In moving the barge 10 from an operational base to a site of pollution, it is anticipated that it would be towed as a unit by one or more suitable tugs. Once on site, the barge will be self-propelled. Each hull, 12 and 14, is provided with fore-and-aft propulsion screws 22 and 24 respectively. Hull 12 is provided with stern and bow thrusters 26 and 27 and hull 14 with stern and bow thrusters 28, 29. When the hulls are joined together as shown, the barge may be operated as a unit from either one of the pilot houses 30 or 32. On-site maneuvering may be done solely by means of the fore-and-aft propulsion screws and the bow/stern thrusters. Preferably, the screws are driven by suitable inboard engines of any well-known type, although a reduced-size version of barge 10 might be propelled by outboard motors.

The barge 10 may of course, be held over a selected location by means of conventional anchoring devices. Alternatively, I prefer to use dynamic positioning for greater flexibility. The fore-and-aft propulsion screws and the bow/stern thrusters provide means for dynamic positioning. To that end, radar dishes 34 and 36 along with navigation satellite antennas 38 and 40, together with the required ancillary equipment of any well known type, are provided. In connection with FIG. 4, there are also shown acoustic transducers 42 and 44 for acoustically positioning barge 10 with respect to fixed, sea-floor-located pingers (not shown). Of course, the barge may also be positioned simply by visual reference to the surface expression of the pollution leak. Dynamic-positioning capability is of great importance in operations in deep water of 100 fathoms or more where use of anchor lines would be impractical and where vagrant currents force the barge to chase the surface expression of the leak away with respect to its source of origin.

The term "dynamic positioning" as commonly used in marine operations, means the act of controlled untethered hovering over a given location at sea. In one method, The pilot/captain uses a joy-stick that controls the various propulsion and thruster screws in a manner to maintain two-dimensional positional control with reference to preordained navigational parameters, either electronic, acoustic or visual.

An important feature of my invention is that each hull, 12 or 14 is self-propelled independently of the other. The two hulls may be uncoupled from each other at the bulkheads 16, 16' and 18, 18' by removing hinge-pins 11 and 11'. Each hull may then be independently dynamically positioned by suitable controls in the corresponding pilot houses 38 and 40. It is important that each hull be provided with adjustable differential ballasting means so that the hulls will be stable in the water when they are operated as independent units.

Figure 4:
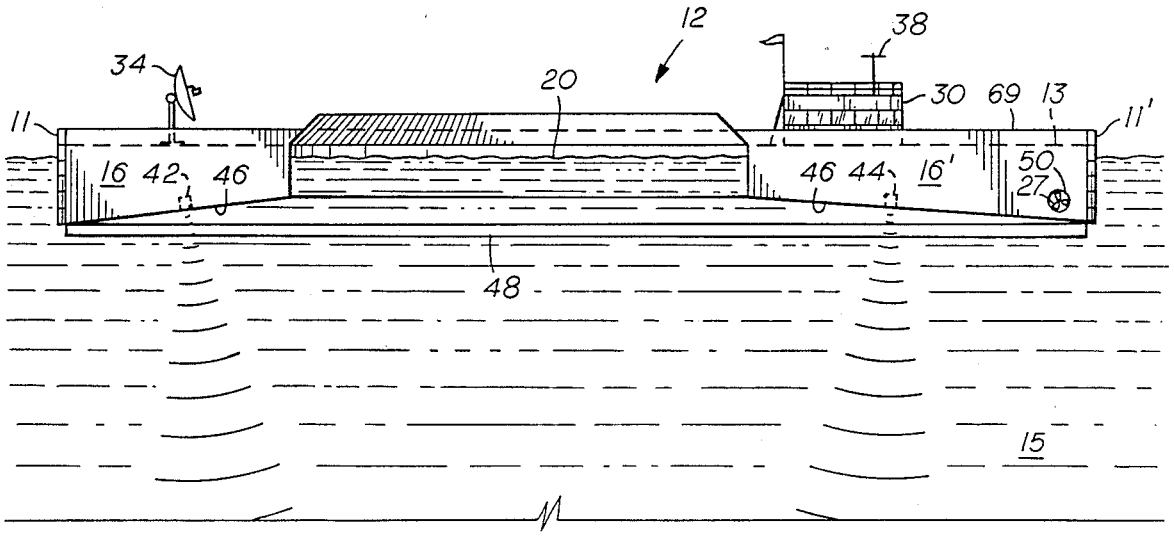
FIG. 4 is a cross section of the barge along line 4—4 of FIG. 3.

FIG. 4 is a side view of hull 12 along line 4–4', which forms the port side of barge 10, floating in a body of water 15. Components previously described under FIGS. 2 and 3 are also shown here. The bottom 46, of the hull is upwardly tapered towards the interior well 20 in the manner of an inverted funnel. The interior well 20 is thus open to the water. A retractable skirt or curtain 48, weighted at the bottom, preferably of a heavy vinyl plastic, hangs beneath the outboard perimeter of the hull. The skirt is designed to be retracted out of the way when the barge is under tow. The combination of the skirt and the upwardly-tapered bottom help to contain and funnel the leaking pollutant into interior well 20 for disposal. Bow thrusters 27 and 29 are typically mounted in tunnels 50, 50' that extend athwartships as is well known in the marine art. Tunnels 50 and 50' communicate with each other when the two hulls are used together as a single unit. Previously-mentioned acoustic transducers 42 and 44 are shown mounted in the bottom 46 of hull 12. Similar transducers are provided for hull 14. Two transducers are shown, but more may be used as desired.

Figure 5:
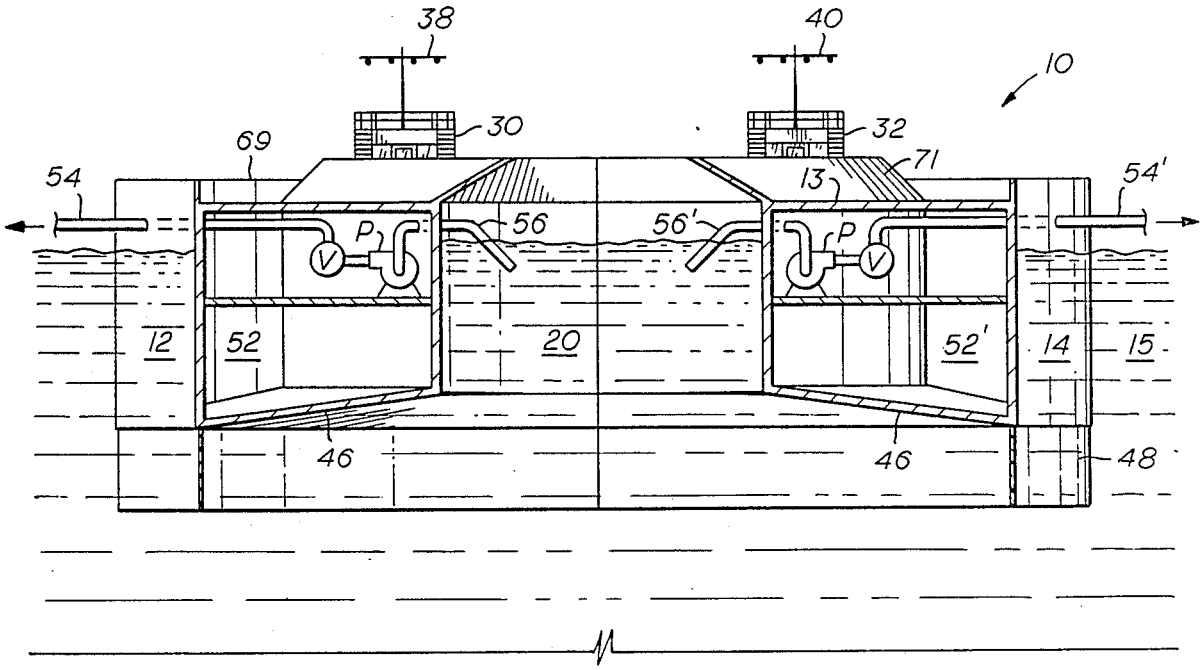
FIG. 5 is a cross section of the barge along line 5—5 of FIG. 3.

FIG. 5 is a cross section of barge 10 along line 5–5', FIG. 3, showing both hulls joined together, floating in water 15. Two holds are shown for each hull. The lower holds 52 and 52' may be used for ballast tanks, pollution holding tanks, fuel tanks, propulsion machinery and the like. The upper holds may contain pumps, P, which suck the accumulated pollution material from interior well 20 and pump it through valves V and out through discharge pipes 54 and 54' for transfer to a pollution-material receiving and transportation means such as a tanker or a floating pipe line (not shown). The mouths of intake pipes 56 and 56' are adjustable as to depth depending upon the thickness of the pollution layer that accumulates in well 20. Either the intake pipes may be physically moved up and down or the entire barge may be ballasted so as to ride with a variable draft in the water.

Figure 6:
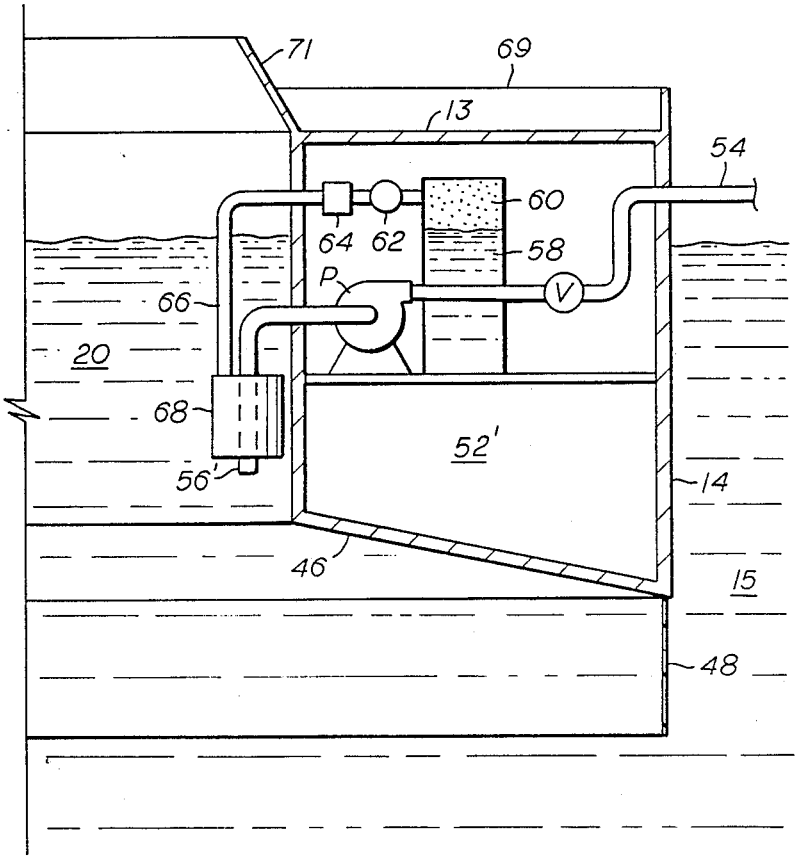
FIG. 6 shows a gas separator that is connected to an igniter for controlled ignition of the separated gas.

FIG. 6 is a modification of FIG. 5 wherein a gas separator 58 is installed after pump P. Gas, that is entrained with the accumulated crude oil, is evaporated out into the upper region, 60, of separator 58. The separated gaseous pollution products pass through valve 62 to an igniter 64 of any well-known to the petroleum industry, where the gas undergoes controlled combustion. The hot products of combustion pass through a flue 66 to jacket 68 to provide heat for thawing congealed blobs of crude that may reside in interior well 20.

If both crude oil and free gas separately exude from the leak, it may be preferable to burn off the gas from the water surface of the interior well 20 as described in the '714 reference patent. Such burning would, of course, assist in thawing congealed crude in interior well 20.

In terms of dimensions, I prefer that hulls 12 and 14 have a draft of about 16 feet, although those dimensions are not limiting, so that they can function in relatively shallow water. The freeboard to the main upper deck, 13, may be about four feet but with an additional 2.5–3 foot closed guard railing, 69 and 71, having suitable drain scuppers, around the outboard and inboard edges of the main upper deck. The inboard railing 71 around interior well 20 is preferably tilted inwardly towards the interior well to minimize sloshing of the pollution over deck 13. Those dimensions make the barge seaworthy in rough weather. Retractable curtain or skirt 48 may hang down as deeply as desired, but I prefer about a four-foot draft.

The hulls 12 and 14 may be separated and arranged in tandem by removing one hinge pin such as 11' from one extremity such as the the bow bulkhead while leaving the stern extremities fastened together. By means of the bow thrusters, the two hulls may swing wide apart like a clam shell to enclose and encompass an extended surface expression of a contamination leak.

Figure 7:
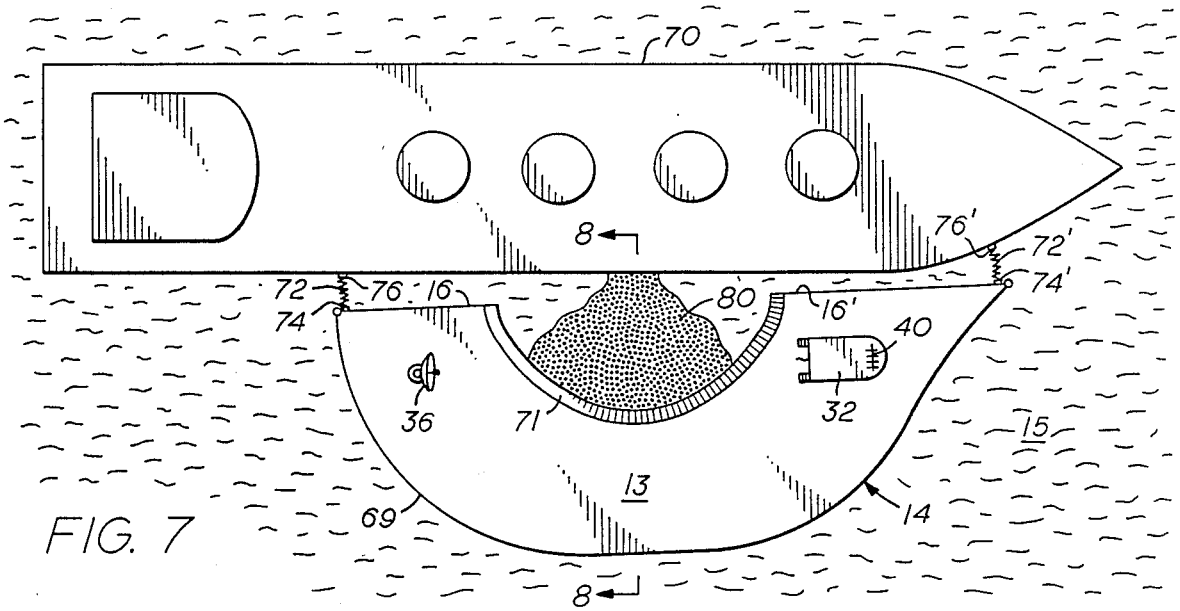
FIG. 7 is a plan view of one of the hulls of the barge secured alongside a leaking tanker ship.

Tankers have been known to founder on sunken reefs, resulting in ruptured storage tanks. In FIG. 7, I deploy one of the barge hulls such as 14, broadside alongside a distressed tanker such as 70. Hull 14 is separated from the side of the tanker by a flexible gasket 72 that may take the form of an expandable bellows. The gasket nay be of any suitable material such as a tough plastic.

Figure 8:
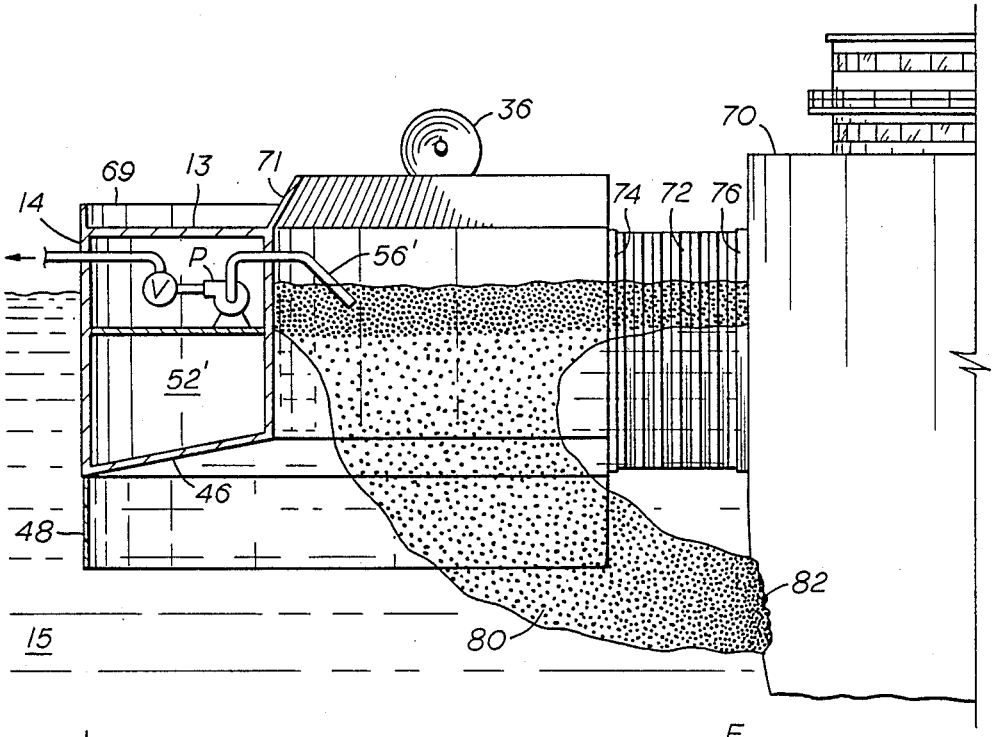
FIG. 8 is a side view along line 8—8 of FIG. 7.

FIG. 8 is a cross section along line 8–8' of FIG. 7. The length of the gasket between tanker 70 and hull 14, may be 20 to 30 feet so that hull 14 does not crash into the side of the tanker 70 and to allow substantial relative movement between the ships in rough weather. The gasket height is comparable to the overall height of hull 14.

Figure 9:
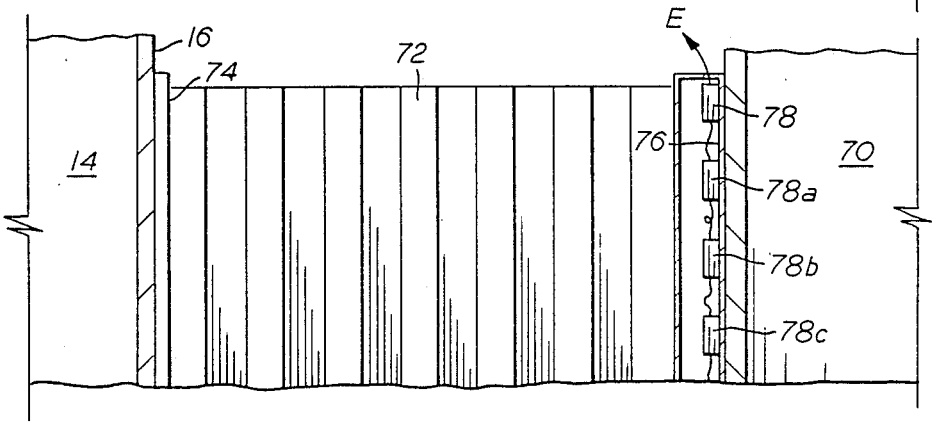
FIG. 9 shows the details of an electromagnetic gasket sealing means.

Gaskets 72 and 72' have inboard contact surfaces 74, 74' and outboard contact surfaces 76 and 76'. Inboard surfaces 74 and 74' are secured to the bulkheads 16 and 16' of hull 14 by any convenient means. FIG. 9 shows the details of my method of sealing the outboard contact surfaces of gasket 72 to the undamaged parts of the side of tanker 70. Electromagnets 78–78*c* are embedded in outboard surface 76 of gasket 72. The electromagnets are electrically connected, via line E, to a source of electrical power (not shown) aboard hull 14. In operation, the outboard contact surfaces 76 and 76' are placed against unruptured portions of the side of tanker 70 and electrical power is applied to the electromagnets to seal the gasket 72 against the steel hull of the tanker. The spillage 80 that issues from rupture 82 of tanker 70 is thus contained by semi-circular hull 14 and between gaskets 72 and 72'. The spilled crude may be collected by the pumping equipment previously described.

To summarize my preferred mode of operation, upon notification of an oil spill, pollution containment barge 10 is towed as a unit by tugs to the site of the catastrophe and is positioned over the surface expression of the contamination. Released from the tugs, the barge may thereafter hover in place by use of dynamic positioning techniques as previously explained. Alternatively, the two hulls 12 and 14, that make up barge 10, may be separated such that each one may be independently maneuvered around the spill to the best advantage. Advancing on the spill, the hulls present to the contamination, a solid wall of substantial dimensions from which the swept-up oil slick cannot readily escape, even in rough weather. For use with a ruptured leaking tanker ship, one or both hulls are positioned broadside, next to the stove-in part of the tanker. Flexible gaskets seal the bulkheads of the hull(s) to the side of the tanker. Preferably, the outboard contact surfaces of the gaskets are magnetically sealed against the undamaged portions of the tanker's steel side.

Many variations in the design and operation of my marine pollution containment device will occur to those skilled in the marine arts, but which will fall within the scope and spirit of my invention which is limited only by the appended claims.

I claim as my invention:

1. A marine pollution containment device, comprising:

a barge, including two substantially semi-circular hulls, each said semi-circular hull including a bulkhead at the opposite extremities thereof;

securing means for fastening said semi-circular hulls together at the bow and stern extremities thereof;

said semi-circular hulls, when fastened together at their extremities, defining an interior well therebetween open to the water, the bottom of each said hull being upwardly tapered towards said interior well in the manner of an inverted funnel; and means, including intake pipes, for pumping accumulated water-polluting material from said well for transfer to a pollution-material receiving and transportation means.

2. The pollution containment device as defined by claim 1, comprising:

means for dynamically positioning said barge over the surface expression of a source of pollution.

3. The pollution containment device as defined by claim 2 wherein:

said barge is self-propelled.

4. The pollution containment device as defined by claim 1, comprising:

means for dynamically positioning each said semi-circular hull with respect to a source of pollution, independently of the other hull.

5. The pollution containment device as defined by claim 4, wherein:

each said semi-circular hull is self-propelled independently of the other.

6. The pollution containment device as defined by claim 2, comprising:

means for separately maneuvering at least one of said semi-circular hulls broadside adjacent a ruptured portion of the side of a leaking tanker ship such that the bulkheads of said at least one semi-circular hull face said ruptured portion.

7. The pollution containment device as defined by claim 6 comprising:

gasket means, having inboard and outboard contact surfaces, positioned between the bulkheads of said at least one semi-circular hull and unruptured portions of the side of said leaking tanker ship.

8. The pollution containment device as defined by claim 7, comprising:

means for securing the inboard contact surface of said gasket means to the bulkheads of said at least one semi-circular hull; and electromagnetic sealing means embedded in the outboard contact surface of said gasket means for sealing the outboard contact surface of said gasket means to the unruptured portions of the side of said leaking tanker ship.

9. The pollution containment device as defined by claim 5, comprising:

means for separating gaseous pollution products from liquid pollution products, igniter means for providing controlled combustion of said separated gaseous products, jacket means mounted around said intake pipes, and flue means interconnecting said igniter means with said jacket means for providing hot combustion products for thawing congealed liquid pollutants resident in said interior well.

10. The pollution containment device as defined by claim 1, comprising:

means for unfastening said semi-circular hulls at one extremity of said hulls while leaving the opposite extremities of said hulls secured together; and means for swinging apart the unfastened extremities of said hulls.

* * * * *